US005423397A

United States Patent [19]

Boughner

[11] Patent Number: 5,423,397

[45] Date of Patent: Jun. 13, 1995

[54] LADDER STABILIZER

[76] Inventor: Raymond B. Boughner, 66 Fox Hill La., Saco, Me. 04072

[21] Appl. No.: 283,541

[22] Filed: Aug. 1, 1994

[51] Int. Cl.[6] ..... E06C 7/00
[52] U.S. Cl. ..... 182/107; 182/172
[58] Field of Search ..... 182/107, 172, 180, 108–111

[56] References Cited

U.S. PATENT DOCUMENTS 1,735,992 11/1929 Bode ..... 182/172 X
3,059,723 10/1962 Shore ..... 182/180 X

FOREIGN PATENT DOCUMENTS 860767 1/1971 Canada ..... 182/107
2180583 4/1987 United Kingdom ..... 182/156

*Primary Examiner*—Alvin C. Chin-Shue
*Attorney, Agent, or Firm*—William Nitkin

[57] ABSTRACT

A ladder stabilizer with structure passing through hollow rungs of a adder and extending beyond each side rail to upright members having bases adapted to rest on the ground and structure within such upright members to adjust the height of the upright member in relation to the slope of the ground to provide lateral stability to the ladder.

4 Claims, 3 Drawing Sheets

LADDER STABILIZER

BACKGROUND OF THE INVENTION

1. Field of the Invention

The device of this invention resides in the area of ladder stabilizers and more particularly relates to a ladder stabilizer for use with a ladder having hollow rung members which device helps to support the ladder when the ladder is positioned against a structure to give the ladder additional lateral stability.

2. Description of the Prior Art

Ladder stabilizing members are known in the art and primarily consist of stand-off members positioned near the top of the ladder with arms extending inward from the ladder to rest on the structure against which the ladder is leaned to support the ladder away from such structure. These stand-off members can extend beyond the side rails of the ladder and provide some lateral support to the upper portion of the ladder. However, such stand-off members provide no lateral stability at the base of the ladder. Some ladders have leveling means which are attached to the side rails to be used on non-level ground where the leveling means can be extended downward from the side rails of the ladder so as to reach the ground to level the ladder. However, such leveling means do not add to the lateral stability of the ladder should the user near the top of the ladder lean off to one side of the ladder.

SUMMARY OF THE INVENTION

It is an object of this invention to provide a ladder stabilizing device which can be utilized with a ladder of the type having right and left side rail members interconnected by a plurality of hollow rung members. The rung members can be round or flattened on their tops but must be hollow to receive therethrough the upper support tube and lower support tube of the structure of this invention which tubes extend through and beyond the right and left side rails of the ladder. At one end the upper and lower support tubes are supported by a support tube upright and at the other end the upper and lower support tubes are inserted, respectively, into an upper receipt tube and a lower receipt tube which receipt tubes are, in turn, supported by a receipt tube upright. Each upright member extends down to a base member located at the bottom of each upright member. In one embodiment the base members can be pivotal base members, and such base members are positioned outward from the side rails of the ladder a distance, in one embodiment, of approximately 20 inches as described further below. By utilizing the ladder stabilizer of this invention, the user can climb to near the top of the ladder and more safely lean off to either side as the base members are offset from the side rails of the ladder and add lateral support to the ladder. The structure of this invention provides significant lateral stability to the ladder and prevents it from easily tipping to one side or the other. The base member at the bottom of each upright member can be adjusted upward or downward by height adjuster members, as will be described further below, so that the ladder stabilizer of this invention can be used on uneven ground surfaces with the adjuster members adjusted so that the base members are level to the surface of the ground.

DESCRIPTION OF THE PREFERRED EMBODIMENT(S)

Figure 1:
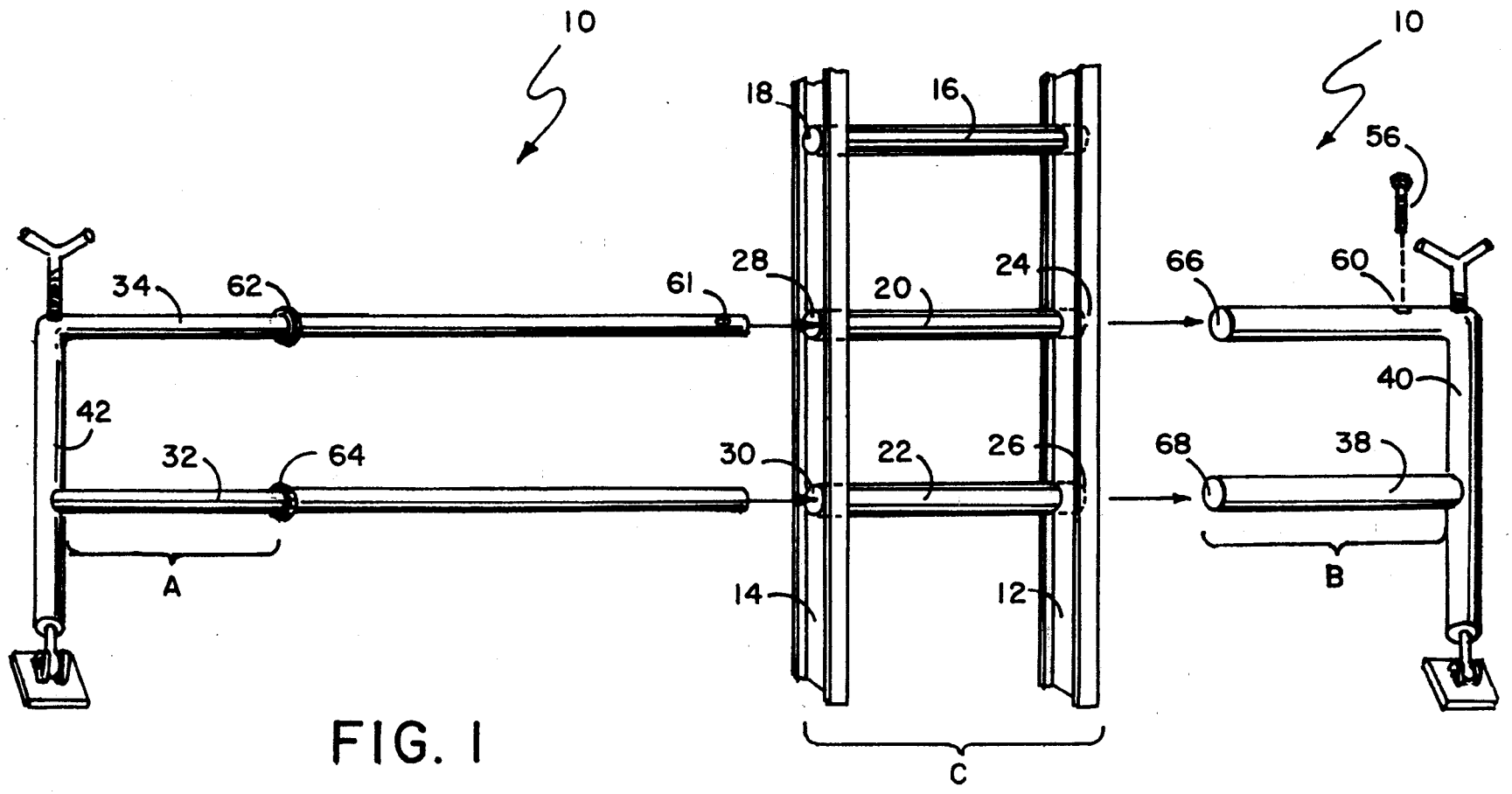
FIG. 1 illustrates a perspective view of the ladder stabilizer of this invention about to be installed in a ladder having hollow rung members.

FIG. 1 illustrates a perspective view of ladder stabilizer 10 of this invention about to be installed in the lower portion of a typical metal ladder having a right side rail 12 and a left side rail 14 with a plurality of hollow rungs therebetween such as, for example, hollow rung 16 with aperture 18 at one end thereof which aperture extends all the way through the rung and through left side rail 14 and right side rail 12. Bottom rung 22 has first aperture 30 in left side rail 14 extending all the way through bottom rung 22 to second aperture 26 at its second end in right side rail 12. Similarly second rung 20 located directly above bottom rung 22 of the ladder, has first aperture 28 at its first end and second aperture 24 at its second end, which apertures extend all the way through hollow second rung 20. The device of this invention is interengaged within the hollow rungs 20 and 22 by having an upper support tube 34 and lower support tube 32 positioned and attached at their second ends to support tube upright 42, the exact distance to align themselves, respectively, with first aperture 30 of second rung 20 and first aperture 28 of bottom rung 22 so that the first ends of upper support tube and lower support tube, being of a size to be inserted into and through first apertures 28 and 30 and can pass through the hollow rungs and can extend out second apertures 24 and 26. In use, lower support tube 32 and upper support tube 34 in one embodiment can extend approximately 20 inches laterally outward from both right side rail 12 and left side rail 14. The portion of the support tubes extending beyond right side rail 12 is inserted into apertures in the first ends of upper receipt tube 36 and lower receipt tube 38 which, in turn, are attached at their second ends to receipt tube upright 40. Upper receipt tube 36 and lower receipt tube 38 extend telescopically, respectively, over upper support tube 34 and lower support tube 32 and contact right side rail 12, respectively, around second aperures 24 and 26. The diameter of upper and lower receipt tubes 36 and 38 is greater than the diameters of second apertures 24 and 26 in the right side rail so that the upper and lower receipt tubes pass over the inserted upper and lower support tubes therein until the upper and lower receipt tubes contact the right side rail and stop. Upper receipt tube 36 and lower receipt tube 32 extend from right side rail 12 a distance, such as 20 inches, to provide lateral support to the ladder against forces that could be exerted if a person should lean off to such side of the ladder. Support tube upright 42 and receipt tube upright 40, being parallel to the side rails, are disposed in a generally upright position depending on the angular positioning of the ladder itself. The receipt tube members can be locked in place on the support tubes by locking means such as by having pairs of lockpin apertures 60 and 61 formed, respectively, through upper receipt tube 36 and upper support tube 34 which apertures, when aligned, allow lock pin 56 to be passed therethrough which pin can be held in place by lock pin catch clip 58 seen in FIG. 2. Receipt tube upright 40 and support tube upright 42 can each have a pivoting base member located at their bottoms that each adjusts to the angle of the ladder when positioned against a structure such as the side of a building. The device of this invention can be constructed of tubing that is circular in cross-section although other shapes of tubing such as oval, square or multi-sided could be utilized. The tubing can be steel, stainless steel, aluminum, magnesium or equivalent strong material. Stainless steel and aluminum have been found to work well.

Figure 2:
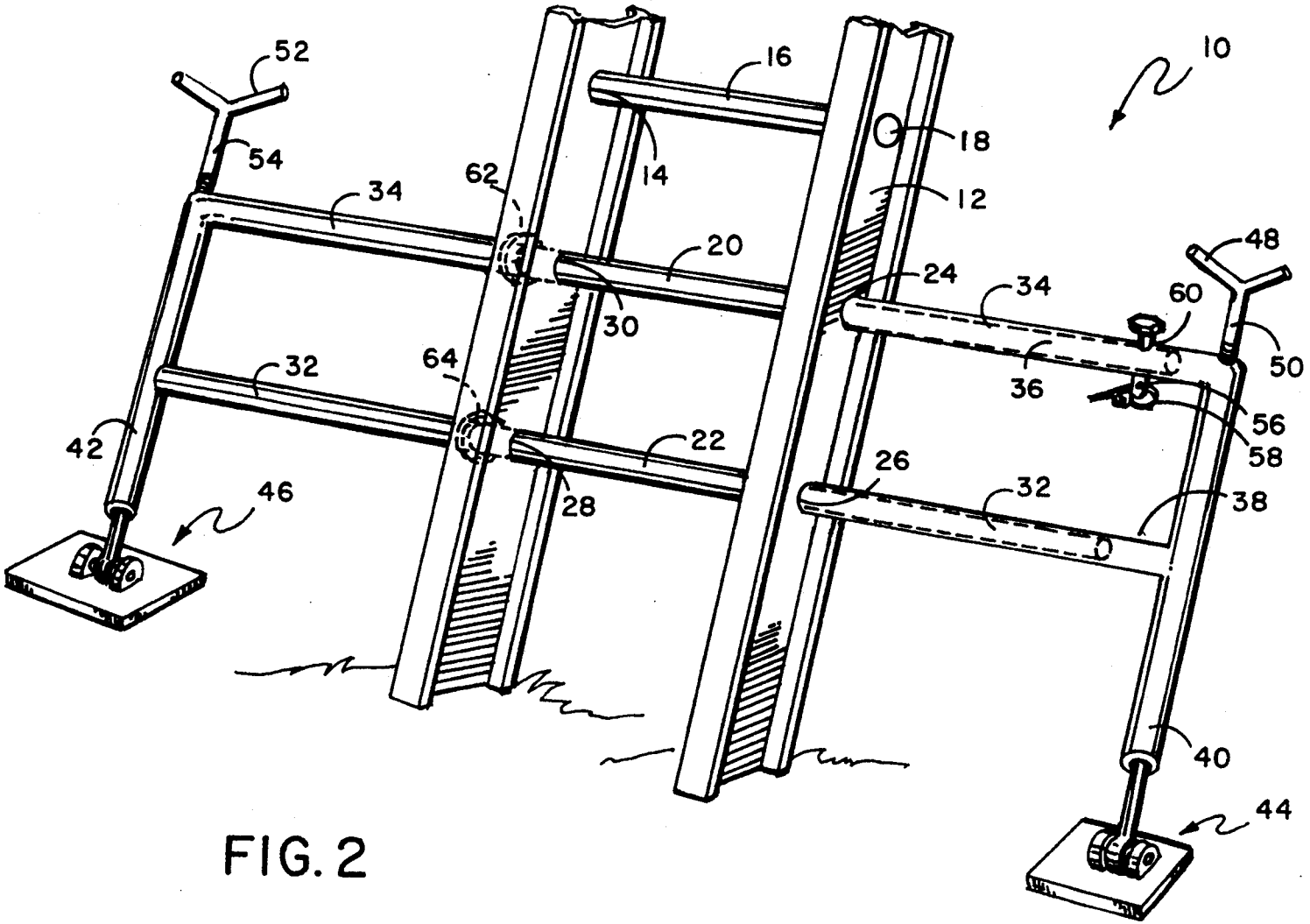
FIG. 2 illustrates a perspective view of the lower portion of a ladder having a hollow rung members with the ladder stabilizer of this invention installed therein.

Seen in FIG. 2 are second pivotal base member 44 and first pivotal base member 46 which base members are adjustable in height or distance away from their respective uprights such that if the ground surrounding the ladder is uneven ground, the pivotal base members can be extended from the uprights to reach the level of the ground thereunder. This feature of the device of this invention is more clearly illustrated in FIG. 3 wherein user 70 is shown leaning to one side of the ladder while painting house 72. The level of the ground directly under left side rail 14 slopes away a distance 76 from the level at which the right side rail rests on the ground such that first base member 46 of support tube upright 42 must be disposed further away from the support tube upright by adjustment means such as extension shaft 74 which the user adjusts in height by rotating first adjuster 52 as described below.

Figure 4:
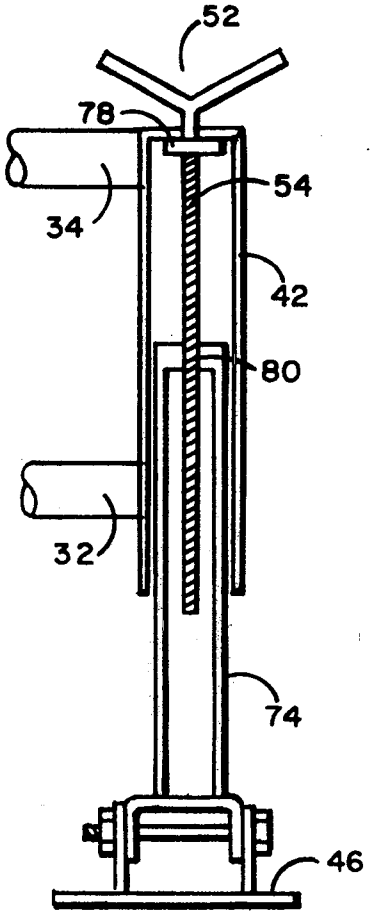
FIG. 4 illustrates a sectional view of an upright member showing its adjustment means to move its base member upward or downward depending upon the level of the ground on which the ladder stabilizer is to be positioned.

A detailed internal view of support tube upright 42 and its adjustment means is seen in FIG. 4 wherein, if first adjuster 52 is rotated, a screw-threaded shaft portion attached thereto being first support tube upright adjustment shaft 54 rotates within support tube member 78 and is engaged by screw action with extension shaft threaded member 80 which is fixed on the top of extension shaft 74 which extension shaft 74 then can be moved up and down within support tube upright 42 by the rotation one way or the other of first adjuster 52 thereby moving first base member 46 upwards or downwards in relation to support tube upright 42. Other height adjustment means can be utilized within the upright members to move their base members up and down to adjust to rest on different levels of ground on the sides of the ladder. For example, other such height adjustment means can include having a pair of telescopically sliding tubes with multiple holes disposed longitudinally in the sides of such tubes and a lock pin that passes through these holes when aligned, with the height adjustment being determined by which pair of aligned holes the lock pin passes through.

Figure 3:
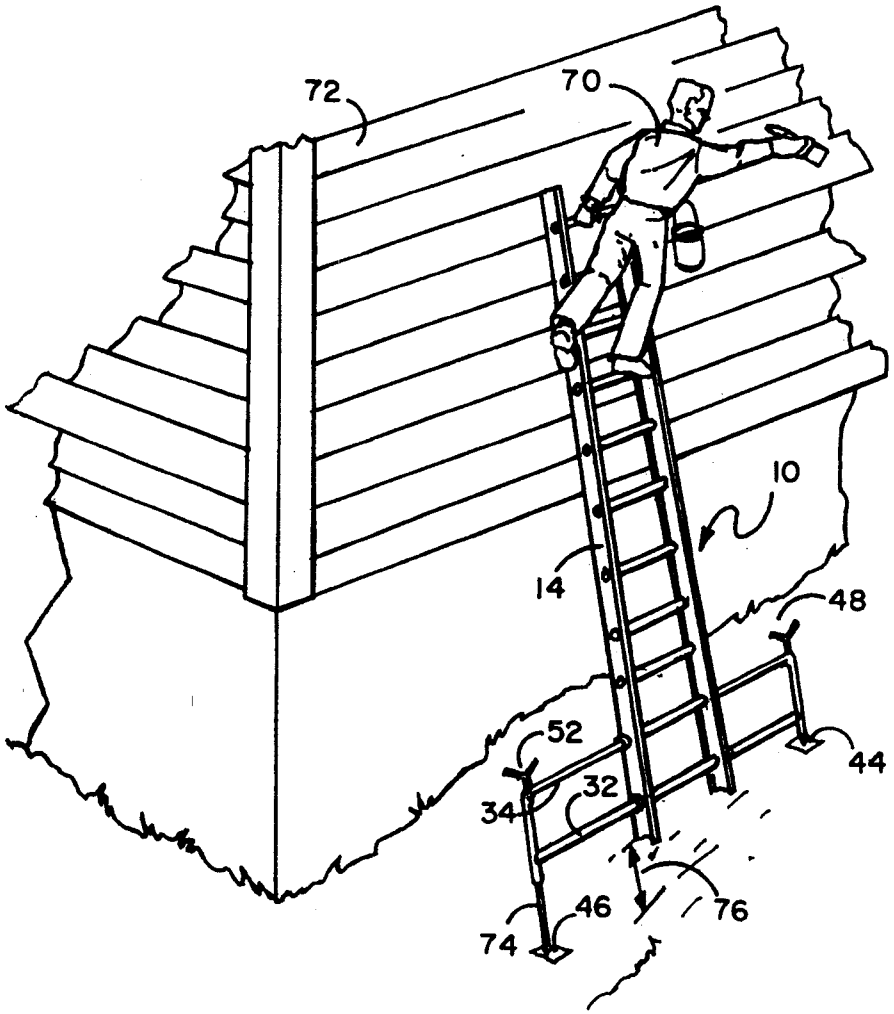
FIG. 3 illustrates a perspective view of a ladder with the ladder stabilizer of this invention installed therein on a sloped ground surface showing an individual leaning away from the ladder at an angle to paint the surface of a building.

As upper support tube 34 and lower support tube 32 are inserted, respectively, into second rung 20 and bottom rung 22, it is desirable that the support tubes of the ladder stabilizer of this invention extend beyond left side rail 14 and right side rail 12 an approximately equal distance. For example, as seen in FIG. 1, the extension of the upper and lower support tubes will be a distance A from the left side rail 14 of the ladder when installed while a similar length B of the upper and lower receipt tubes is provided at the right side of the ladder beyond right side rail 12 when the device of this invention is installed as seen in FIG. 2. In one embodiment width C of the ladder can be approximately the same as distances A and B. Many ladders have a width between 17–19 inches, and the spacing of the support tube uprights 42 and 40 away, respectively, from the left and right side rails of the ladder can be generally equal to the width of the ladder with 20 inches being a good compromise distance considering portability, cost and stability of the device. It has been found, though, that lengths A and B can fall in the range of 10–30 inches and still work well. To help obtain a desired specific length for A, a left side rail upper stop member 62 is provided on upper support tube 34, and a left side rail lower stop member 64 is provided on lower support tube 32 such that as the upper and lower support tubes are moved, respectively, through the apertures in second rung 20 and bottom rung 22, the advancement of the support tubes will stop at a desired position when stop members 62 and 64 hit left side rail 14 of the ladder. Stop members 62 and 64 can be auto or aviation hose-type clamps installed on the support tubes and which members have larger diameters than the diameters of the apertures in the ladder's hollow rungs so as to stop any further inward movement when they contact the ladder's side rail. The position of the stop members on the support tubes can be easily changed by loosening them and moving them to a new position and retightening them. By positioning the support tube upright and the receipt tube upright and their associated base members a lateral distance in the range of 10–30 inches away, respectively, from the left and right side rails of the ladder with a distance of 20 inches working well, a great deal of additional stability is provided to the ladder, allowing the user, as seen in FIG. 3, to lean to one side away from the ladder yet still be supported, for example, by second base member 44 that is almost directly under the body of user 70. In this way user 70 can lean laterally away from the ladder on either side and, for example, paint or otherwise work on a large area without having to stop and move the ladder frequently.

Although the present invention has been described with reference to particular embodiments, it will be apparent to those skilled in the art that variations and modifications can be substituted therefor without departing from the principles and spirit of the invention.

I claim:

1. A ladder stabilizing device in combination with a ladder having a left side rail and a right side rail, each having an outer side, with a plurality of hollow rungs disposed therebetween, said hollow rungs each having a first end disposed at said left side rail and a second end disposed at said right side rail, said ladder having a lower portion wherein is disposed a bottom hollow rung with a second hollow rung positioned above said bottom hollow rung, said left side rail having a first left aperture and a second left aperture defined therein and said right side rail having a first right aperture and a second right aperture defined therein, said first left aperture and second left aperture in communication, respectively, with said first ends of said bottom hollow rung and said second hollow rung, and said first right aperture and said second right aperture in communication respectively with said second ends of said bottom hollow rung and said second hollow rung;

an upper support tube having a first end and a second end and a lower support tube having a first end and a second end, said first ends of said upper and lower support tubes passing, respectively, through said second left aperture and first left aperture and, respectively, through said second hollow rung and bottom hollow rung and, respectively, out said second right aperture and first right aperture and extending laterally from said ladder on both sides thereof, said upper support tube and lower support tube each having a length sufficient to extend beyond said outer sides of said left side rail and said right side rail distances in the range of approximately 10–30 inches on each side thereof;

a first upright member having a top and a bottom, said first upright member attached to said second ends of said upper support tube and said lower support tube;

an upper hollow receipt member having a first end and a second end and a lower hollow receipt member having a first end and a second end, said first ends of said upper and lower hollow receipt member having an aperture defined therein, said first ends of said upper support tube and said lower support tube inserted, respectively, in said apertures in said first ends, respectively, of said upper hollow receipt member and said lower hollow receipt member;

a second upright member having a top and a bottom, said second upright member attached to said second ends of said upper hollow receipt member and said lower hollow receipt member;

a stop member disposed at a preselected point on at least one of said support tubes to stop said tube's advancement into its associated hollow rung of said ladder at a point where the extensions of said support tubes from said outer sides of said ladder's side rails position said first and second upright members, respectively, a distance equidistant from said outer sides of said ladder's side rails; and a first base member and a second base member, said first and second base members disposed, respectively, at said bottoms of said first upright member and said second upright member, said ladder stabilizing device in its use mode having said first and second upright members and their respective base members disposed laterally, respectively, from said left side rail and said right side rail of said ladder.

2. The device of claim 1 wherein said first and second base members are pivotally mounted, respectively, to said bottoms of said first and second upright members.

3. The device of claim 2 further including means to adjust said first and second base members upwards and downwards.

4. The device of claim 3 further including means to lock a support tube in position within its associated hollow receipt member and for said first ends of said upper and lower hollow receipt members to contact said right side rail of said ladder.

* * * * *